US006487976B1

(12) United States Patent
Robison et al.

(10) Patent No.: US 6,487,976 B1
(45) Date of Patent: Dec. 3, 2002

(54) SPLIT CAM BAR FOR CHAIN-TO-CHAIN TRANSFER

(75) Inventors: Rodney K. Robison, Warren, MI (US); James P. Fahner, Garden City, MI (US); Jeffrey F. Kaufman, Macomb Township, MI (US); Robert J. MacKenzie, Shelby Township, MI (US); Greg A. Whitehead, Wixom, MI (US)

(73) Assignee: Jervis B. Webb Company, Farmington Hills, MI (US)

( * ) Notice: Subject to any disclaimer, the term of this patent is extended or adjusted under 35 U.S.C. 154(b) by 0 days.

(21) Appl. No.: 09/689,835

(22) Filed: Oct. 13, 2000

(51) Int. Cl.[7] ..... B61B 10/00

(52) U.S. Cl. ..... 104/172.2; 104/172.4; 198/370.02

(58) Field of Search ..... 104/172.1, 172.2, 104/172.3, 172.4, 130.07; 198/370.01, 370.02, 370.03

(56) References Cited

U.S. PATENT DOCUMENTS

| | | | | | |
|---|---|---|---|---|---|
| 3,742,861 | A | | 7/1973 | Wilkinson | |
| 3,812,787 | A | * | 5/1974 | Kling | 104/172.4 X |
| 4,214,535 | A | * | 7/1980 | Gerhard | 104/130.07 X |
| 4,223,610 | A | | 9/1980 | Lempio | |
| 4,542,698 | A | | 9/1985 | Wakabayashi | |
| 4,616,570 | A | | 10/1986 | Dehne | |
| 4,702,174 | A | * | 10/1987 | Tredwell et al. | 104/172.2 |
| 4,771,700 | A | | 9/1988 | Wakabayashi | |
| 4,885,997 | A | | 12/1989 | Wakahayashi | |
| 4,939,999 | A | | 7/1990 | Burt et al. | |
| 5,368,152 | A | * | 11/1994 | Rhodes | 104/172.2 X |
| 5,507,233 | A | | 4/1996 | Kwon et al. | |
| 5,517,922 | A | | 5/1996 | Summa et al. | |
| 5,549,050 | A | * | 8/1996 | Rhodes | 104/172.2 X |
| 5,606,915 | A | | 3/1997 | Harris | |
| 5,664,501 | A | | 9/1997 | Harris | |
| 5,842,421 | A | | 12/1998 | Desilets et al. | |
| 5,852,979 | A | | 12/1998 | Desilets et al. | |

* cited by examiner

*Primary Examiner*—James R. Bidwell
(74) *Attorney, Agent, or Firm*—Dickinson Wright PLLC

(57) ABSTRACT

A cam bar assembly for transferring a trolley from driving engagement with a first chain to driving engagement with a second chain wherein the cam bar assembly includes a cam bar having a first longitudinal axis, a cam surface centered about the first longitudinal axis, a second longitudinal axis, and a cam face centered about the second longitudinal axis. The second longitudinal axis is offset from the first longitudinal axis. The present invention is also directed to a power and free conveyor having the cam bar assembly as well as a drive trolley disposed within a free track for movement in a driven direction and having a retractable surface movable between an engaging position and a retracted position. The power and free conveyor also includes a first drive chain, a second drive chain, and a transfer zone having an entrance and an exit. The first drive chain is positioned to drivably engage the drive trolley at the entrance and the second drive chain is positioned to drivably engage the drive trolley at the exit. The cam bar is positioned in the transfer zone to engage the drive trolley and move the retractable surface from its engaging position to its retracted position.

13 Claims, 7 Drawing Sheets

SPLIT CAM BAR FOR CHAIN-TO-CHAIN TRANSFER

BACKGROUND OF THE INVENTION

1. Technical Field

The present invention generally relates to material handling conveyors and, more particularly, to a transfer assembly for a chain driven conveyor system.

2. Discussion

A wide variety of conveyor systems are available in the art for transporting articles through a manufacturing facility. For example, power and free (PF) chain conveyor systems which generally include trolleys coupled to move a workpiece. The trolleys are commonly freely movable within a support track which is positioned to place the trolleys in operative engagement with a drive chain having pusher dogs. The dogs drivably engage the trolleys to move the trolleys through the manufacturing area.

In many PF conveyor systems the workpiece and associated trolleys are transferred between separate drive chains so that one of the chains can move the workpiece through a first work area and the second chain can move the workpiece through a second work area. A chain-to-chain transfer assembly is commonly provided in the PF conveyor system to transfer the trolleys between driving engagement with the first chain (the wipe-off chain) and the second chain (the wipe-on chain). More particularly, during the transfer operation, a pusher dog fixed to the wipe-off chain brings the trolley into a transfer zone where the wipe-off and wipe-on pusher dogs could simultaneously engage the trolley. To prevent simultaneous engagement, a mechanical cam is positioned to move the retractable dog of the trolley to a height where the wipe-off chain, but not the wipe-on chain, is engageable with the trolley. The wipe-off chain is therefore able to push the trolley to a point in the transfer zone where the trolley drops off the cam bar and into its engaging position where the wipe-on dog can move the trolley away from the transfer zone.

A representative prior art transfer operation is illustrated in FIGS. 1–5 and includes a wipe-off drive chain 10 that drives a trolley 14 into the transfer zone and a wipe-on drive chain 12 that drives the trolley out of the transfer zone. A cam bar 16 is positioned in the transfer zone between the wipe-off and wipe-on drive chains and is configured to operatively engage a retractable dog 18 on the trolley 14 (FIGS. 3 and 4) to transfer the trolley from driving engagement with the wipe-off drive chain 10 to driving engagement with the wipe-on drive chain 12.

More particularly, the wipe-off drive chain 10 drives the retractable trolley dog 18 onto the cam bar which is configured to raise the trolley dog from a lowered position to a raised position (shown in FIG. 4 and in shadow in FIG. 5). The wipe-off track then curves away from the cam bar such that the wipe-off pusher dog 20 (FIG. 4) is moved out of engagement with the trolley dog 18. If the trolley 14 has sufficient momentum, the trolley dog passes by the forward end 24 (FIGS. 1 and 2) of the cam bar, drops into its lowered engaging position, and is drivably engaged by the next wipe-on pusher dog 22. When the retractable dog 18 is in its raised position, the pusher dog 22 of the wipe-on drive chain 12 is positioned below and operably disengaged from the drive surface 25 of the retractable dog 18 (FIG. 4). The cam bar 16 maintains the retractable dog in this raised position until the rear surface of the retractable dog slides off the cam bar thereby permitting the retractable dog to return to its engaging position. The wipe-on chain dog 22 is then operably engageable with the lowered retractable dog 18 so as to push the carrier trolley out of the transfer zone.

The smooth operation of the PF conveyor system depends upon the efficient transfer of trolleys from the wipe-off drive chain to the wipe-on drive chain. Even a small percentage of missed transfers cause manufacturing inefficiencies. Missed transfers are most common in the prior art design when the wipe-off chain is moving slower than the wipe-on chain 12. With a slow moving wipe-off chain and correspondingly slow moving trolley, the trolley may have insufficient momentum to overcome the sliding friction between the riding surface 26 of the trolley and the cam bar. The trolley then occasionally gets caught up on the cam bar which maintains the retractable dog 18 in its retracted position and therefore not drivably engageable by the pusher dog 22 on the wipe-on drive chain 12. The trolley 14 then sits on the cam bar and obstructs the movement of the next trolley causing a blockage of trolley transfer.

A representative trolley, such as the Dog Magic® trolley manufactured by Jervis B. Webb Company of Farmington Hills, Mich., the assignee of the present invention, is illustrated in FIGS. 3–5 to include an anti-backup tail 28 located rearward of the riding surface 26. The riding surface 26 includes a lead end 30 and a trailing end 32 while the anti-backup tail 28 includes a rear tip 34 spaced from the trailing end 32 as indicated by reference numeral 36. When the trolley has insufficient forward momentum, the trolley 14 may come to rest with the tail 28 sitting on the cam bar thereby prohibiting the retractable dog 18 from fully returning to its engaging position and preventing the wipe-on pusher dog 22 from operatively engaging the dog 18.

In an attempt to decrease the frequency of the trolley getting caught up on the cam bar, the prior art has used various auxiliary pushing mechanisms (e.g., such as air cylinders that impact the rear of the trolley 14) to increase the forward momentum of the trolley. While these techniques have provided some increase in efficiency, 100% transfer, particularly during slow wipe-off and fast wipe-on speeds, have not been achieved.

SUMMARY OF THE INVENTION

In view of the above, a need exists for a cam bar design that more efficiently transfers trolleys from driving engagement with the wipe-off chain to driving engagement with the wipe-on chain. The improved cam bar design addresses both of the above-identified sources of trolley interference: the riding surface of the trolley getting caught up on the cam bar and the anti-backup tail remaining on the cam bar after the retractable trolley dog clears the downstream end of the cam bar. Accordingly, the present invention includes an improved cam bar design having a primary cam bar and a secondary cam bar that is longitudinally separated and axially offset from the primary cam bar. The many advantages of this arrangement include reducing the length of the dead zone, i.e., the zone where the wipe-off and wipe-on chains are each operably disengaged from the trolley and the trolleys momentum is relied upon to clear the cam bars, and arranging the offset of the split cam bars to permit the retractable dog to drop fully into its engaging position even if the trolley stops when the retractable dog is at the downstream end of the secondary cam bar. Under this condition, the anti-backup tail fully clears the first cam bar at approximately the same time the riding surface of the retractable dog drops off the secondary cam bar. This design virtually eliminates missed take-away chain dogs and reduces the possibility of drive torque outs due to trolleys jamming into pusher dogs.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

Figure 1:
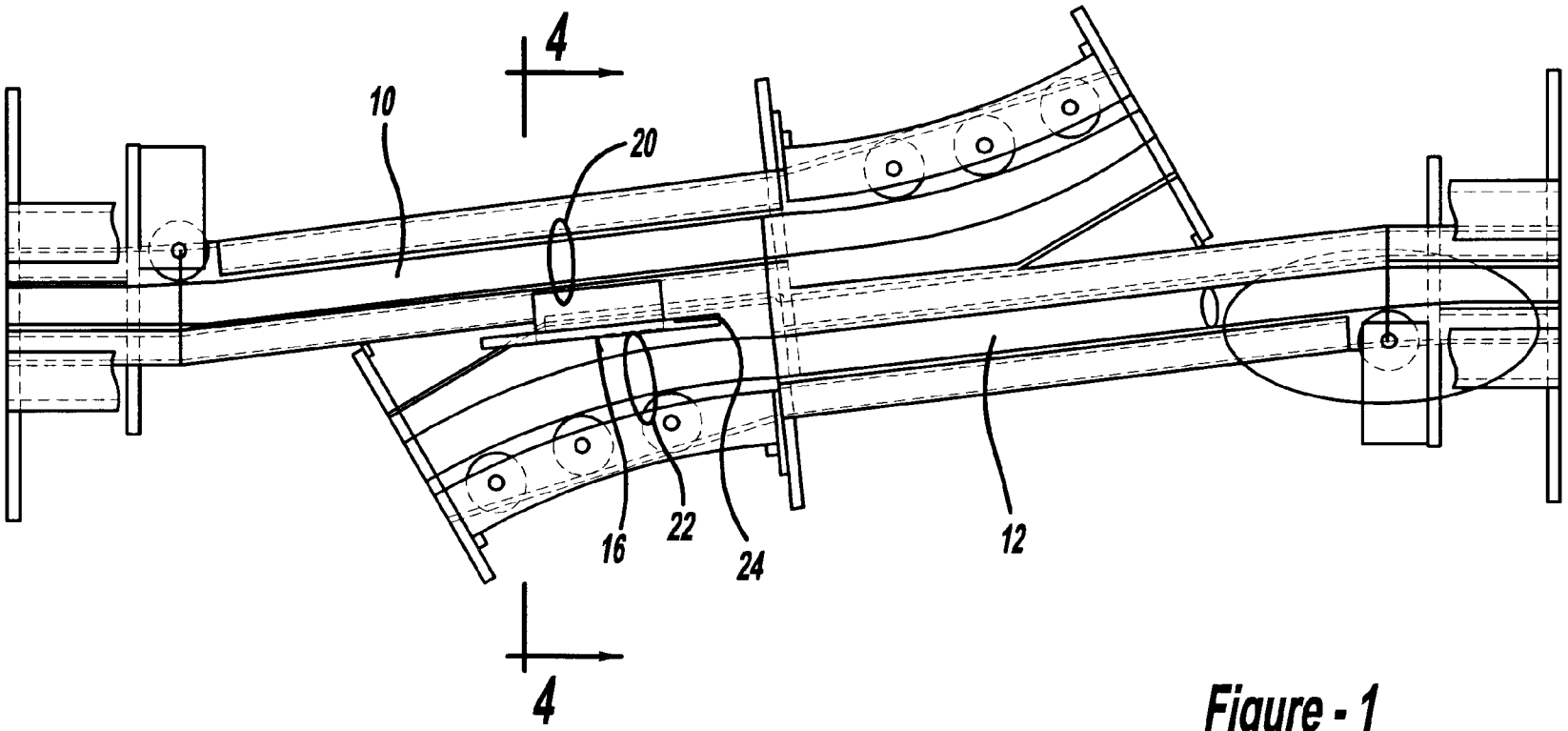
Figure - 1 PRIOR ART
FIG. 1 is a top plan view of a prior art chain-to-chain transfer.
Figure 2:
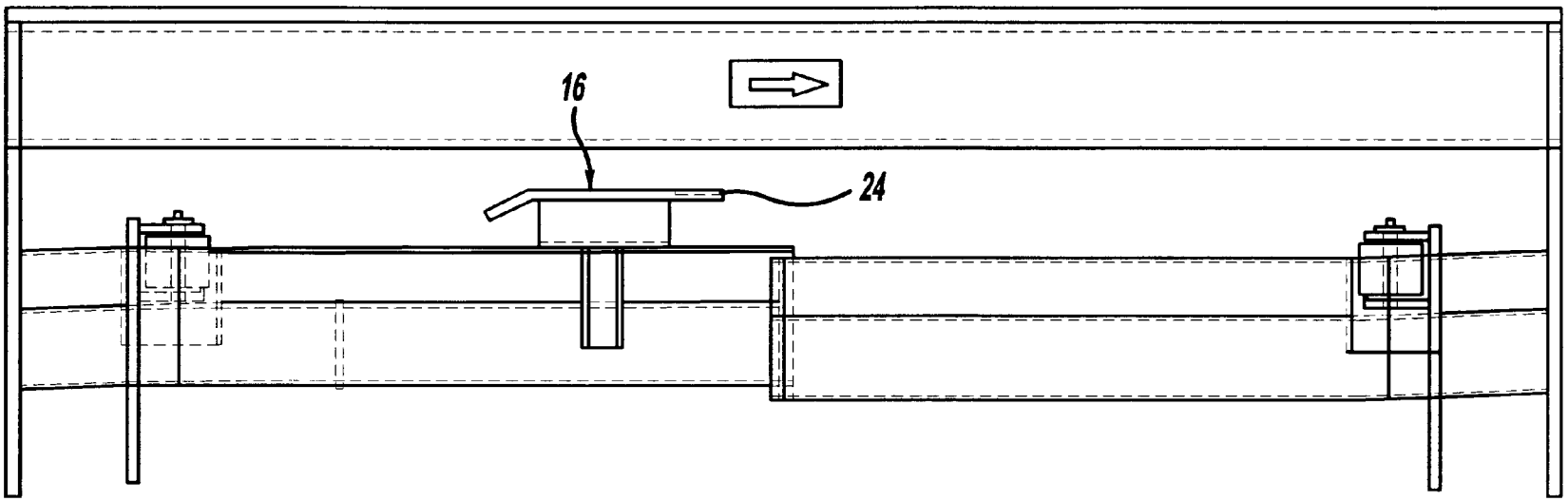
Figure - 2 PRIOR ART
FIG. 2 is a side elevational view of the prior art design shown in FIG. 1.
Figure 3:
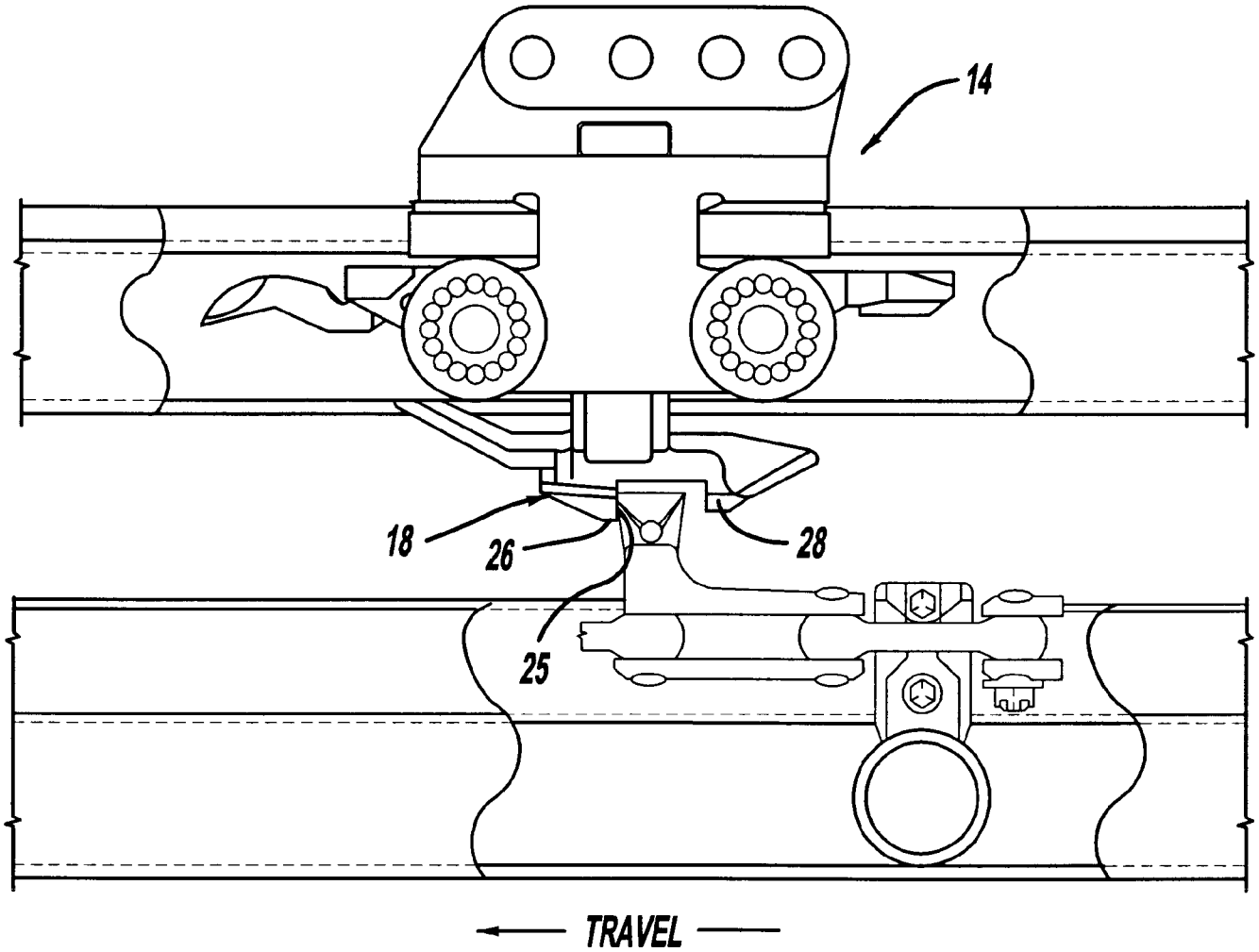
Figure - 3 PRIOR ART
FIG. 3 is a side elevational view of a prior art free track, trolley, drive track, and drive chain.
Figure 4:
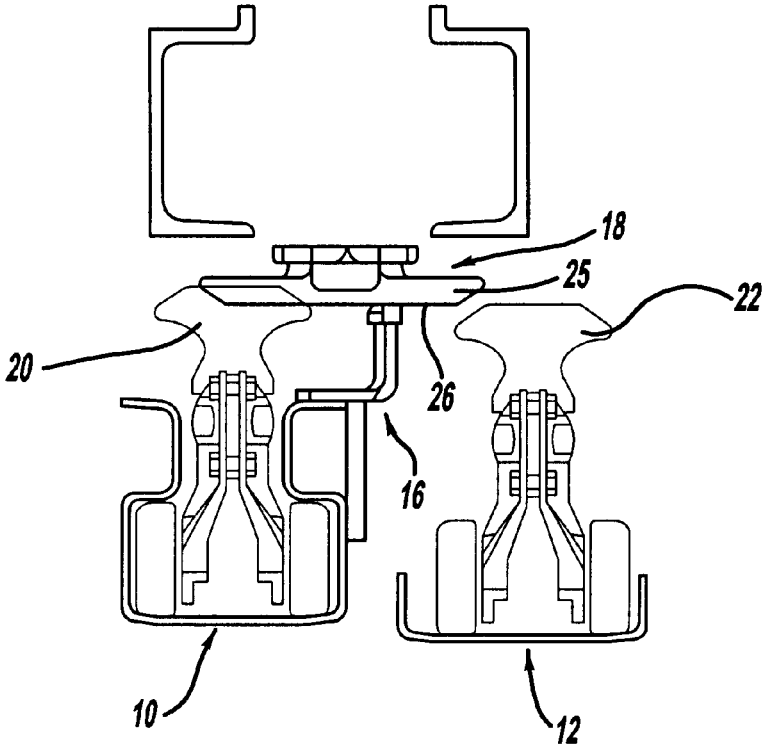
Figure - 4 PRIOR ART
FIG. 4 is a sectional view taken along the line 4—4 shown in FIG. 1 and illustrating the wipe-off chain, wipe-on chain, cam bar, and retractable trolley dog.
Figure 5:
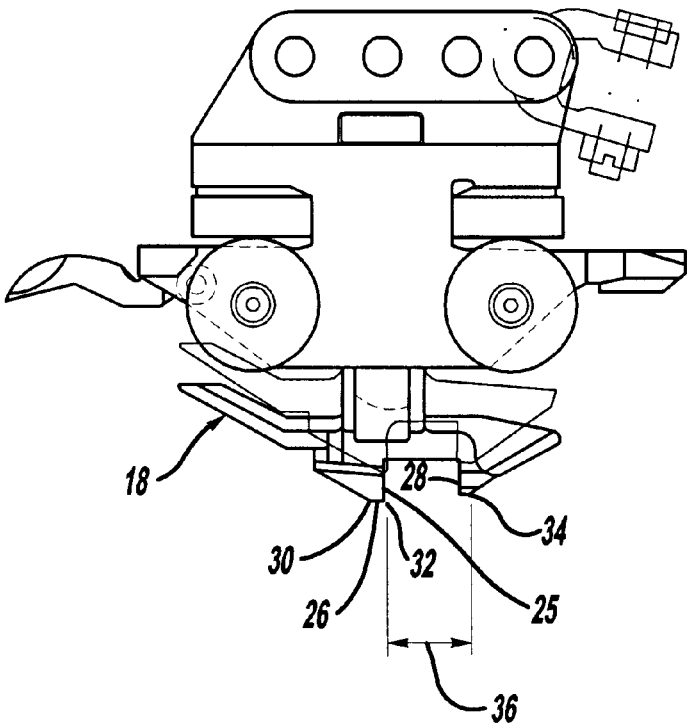
Figure - 5 PRIOR ART
FIG. 5 is a side elevational view of the prior art trolley shown in FIG. 3.
Figure 6:
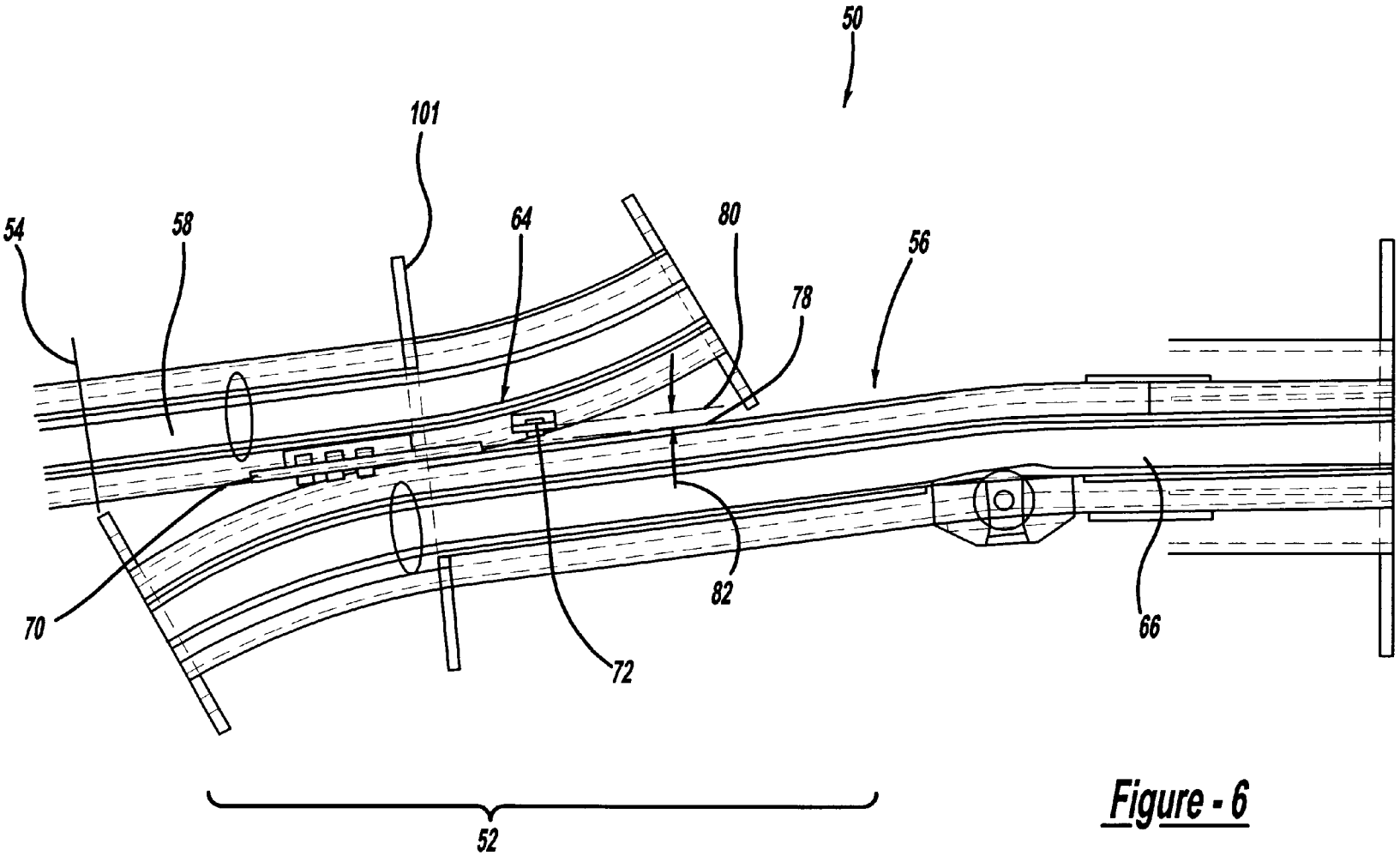
FIG. 6 is a top plan view of a conveyor system according to the present invention.
Figure 7:
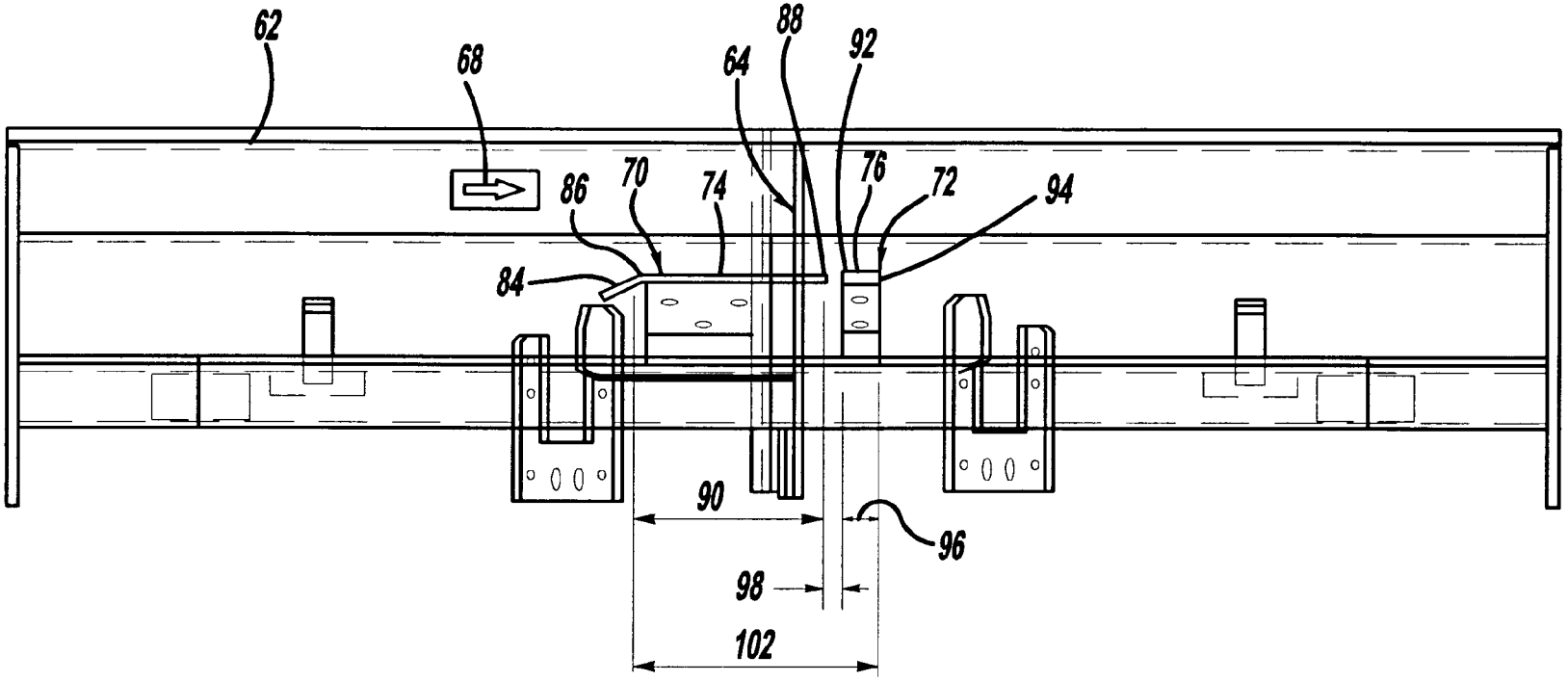
FIG. 7 is a side elevational view of the conveyor system shown in FIG. 6.
Figure 8:
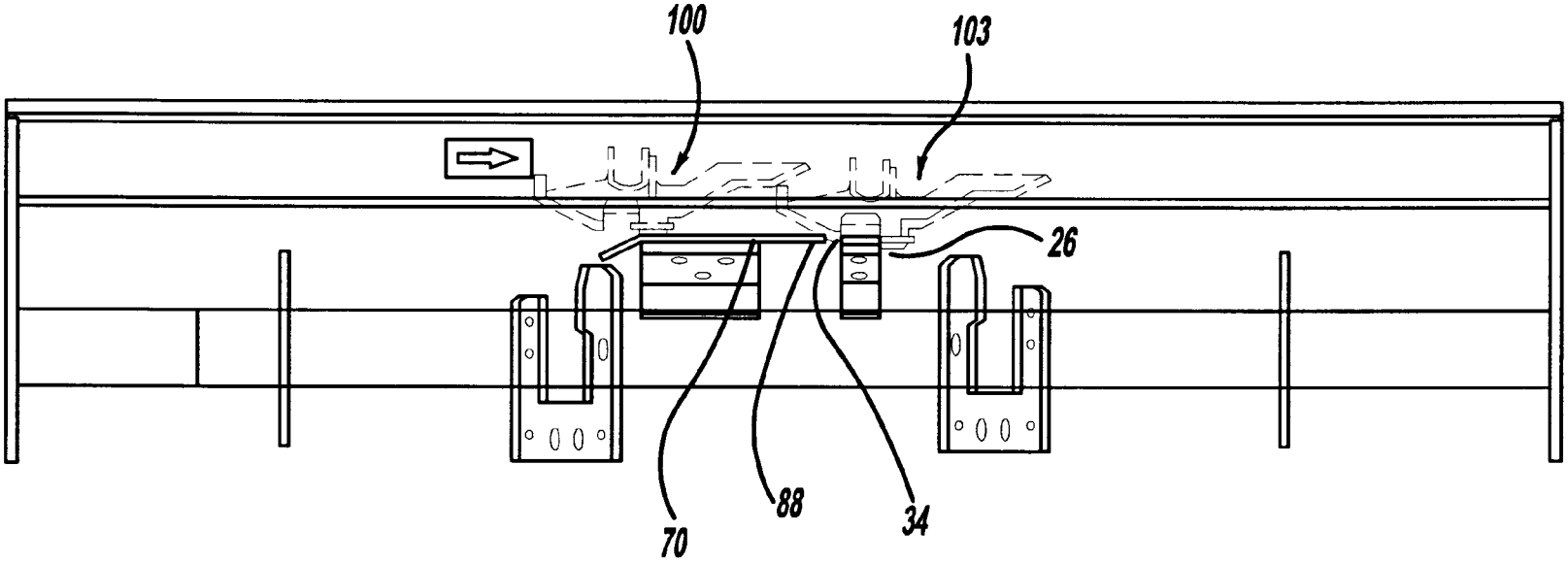
FIG. 8 is a side elevational view similar to that shown in FIG. 7 and further illustrating representative locations of the retractable trolley dog.

A portion of a power and free conveyor system 50 according to the present invention is illustrated in FIGS. 6–8 to include a transfer zone 52, having an entrance 54 and an exit 56, a first drive chain 58, a free track 62 within which the trolleys move, and a second drive chain 66. Just as in the prior art configuration shown and described above, the first and second drive chains 58 and 66 converge toward one another in the transfer zone 52 to permit the trolleys to be transferred from driving engagement with the first drive chain 58 to driving engagement with the second drive chain 66. The transfer zone 52 includes a cam bar assembly 64 positioned to operably engage the trolleys for transferring the trolleys to the second drive chain 66. The general configuration of the first and second drive chains, the free track, and the trolleys are generally known in the conveyor art and may include the configurations described with reference to FIGS. 1–5.

The first drive chain 58 preferably curves away from the cam bar assembly after the cam bar assembly 64. Conversely, the second drive chain 66 approaches the cam bar assembly so as to place the pusher dogs on the second drive chain into operative engagement with the trolleys after the trolleys pass the cam bar assembly. While a specific configuration of the transfer zone is illustrated and described herein, it should be appreciated that a variety of alternative transfer zone arrangements may be used with the present invention without departing from the scope of the invention. By way of example, while the power and free system is described herein as being an inverted system, that is, where the workpiece is supported above the drive chains, the present invention is equally suitable for non-inverted systems.

The cam bar assembly 64 includes a first cam bar 70 that precedes a second cam bar 72 in relation to the driven direction 68. The first and second cam bars include an upper cam surface 74 and an upper cam face 76 (FIG. 8), respectively, for engagement with the riding surface 26 (FIG. 3) of the trolley. The cam surface 74 and cam face 76 are preferably centered along first and second longitudinal axes 78 and 80, respectively (FIG. 6). The second longitudinal axis 80 is spaced from the first longitudinal axis 78 in a direction generally perpendicular to the driven direction 68 to define an offset 82. Additionally, the first cam bar 70 includes an angled engagement surface 84 positioned in the line of travel of the retractable dog when the retractable dog is in its engaging position. The angled engagement surface 84 terminates at a rear end 86 of the cam surface 74 which extends to a front end 88 to define a surface length 90 (FIG. 7).

Similarly, the second cam bar 72 includes a rearward end 92 and a forward end 94 between which the cam face 76 extends to define a face length 96. The rearward end 92 of the second cam bar 72 is spaced forward of the front end 88 of the first cam bar 70 to define an axial spacing 98 therebetween. The axial spacing 98 shown in FIG. 7 is preferably slightly greater than the spacing 36 between the rear tail tip 34 and the riding surface trailing end 32 of the retractable dog (FIG. 5).

In operation, the first drive chain 58 pushes the trolley onto the first cam bar 70 causing the riding surface 26 of the retractable dog 18 to move into and be maintained in its vertically retracted position. A trolley dog 100 is shown in this position in FIG. 8. As the first drive chain 58 moves the lead end 30 of the retractable dog off the cam face 76 of the second cam bar 72, the first drive chain, and its respective pusher dogs, are disengaged from the retractable dog by sloping the chain horizontally away from the cam bar assembly. The increased horizontal divergence of the first drive chain from the trolley generally begins at a transfer axis 101 (FIG. 6) but may be varied without departing from the scope of the invention. Similarly, prior to the transfer axis 101, the second drive chain is horizontally positioned relative to the free track 62 to place the pusher dogs of the second drive chain in operative alignment with the retractable trolley dog. More particularly, the pusher dogs are horizontally positioned within the lateral extent or width of the riding surface 26 and vertically positioned to engage the drive surface 25 (FIGS. 3–5) of the retractable dog if the retractable dog were in its engaging position. However, as noted above, the cam bar assembly maintains the retractable dog in its partially retracted position, engageable by the pusher dog of the first drive chain but not the pusher dogs of the second drive chain, until the trailing end 32 clears the forward end 94 of the second cam bar 72.

As noted above, in the preferred embodiment, the first drive chain is maintained in driving engagement with the driving surface 25 of the retractable dog 18 until the trailing end 32 of the retractable dog disengages or falls off the cam face 76 of the second cam bar 72. At this point, the rear tip 34 of the anti-backup tail 28 clears the front end 88 of the first cam bar 70 and the retractable dog drops into its engaging position as shown by trolley dog 103 in FIG. 8. The offset 82 between axes 78 and 80 and the corresponding lateral gap between the first and second cam bars permits the anti-backup tail 28 to pass the second cam bar 72 when the retractable dog is in its engaging position.

In the preferred embodiment, the surface length 90 is approximately eleven and one-half (11½) inches, the face length 96 of the second cam bar 72 is approximately two (2)

inches, and the axial spacing 98 between the first and second cam bars approximately equal to the axial length of the anti-backup tail 28 of the trolley. In the preferred operation, the pusher dog of the first chain remains in engagement with the trolley even after the riding surface 26 is supported by the second cam bar 72. Conversely, in the prior art design illustrated in FIGS. 1 and 2, the wipe-on pusher dog is disengaged from the trolley prior to the riding surface clearing the single cam bar. Thus, the split cam bar of the present invention permit the first drive chain to more effectively and consistently move the trolleys off the cam bar. The present invention also reduces the length of the interference zone, i.e., the zone where both pusher dogs could engage the trolley if the cam bar was not present, from approximately ten inches as is common in prior art configurations to approximately one-half to three-quarters of an inch. A reduced interference zone length increases the efficiency of the transfer provided by the cam bar assembly. Those skilled in the art should appreciate that while these dimensions have been found to be particularly suitable for the invention, various other dimensions may be used without departing from the scope of the invention as defined by the appended claims.

From the above description, it should be appreciated that the present invention efficiently transfers trolleys between drive chains through the use of a unique split cam bar design. The split cam bar design reduces the interference zone within the transfer area and provides a design where the riding surface of the trolley drops from its retracted position to its engaging position at about the same time the anti-backup tail clears the first cam bar. These design improvements provide greater overall transfer efficiencies, approaching 100% transfer, for virtually all drive chain speeds including slow delivery chain speeds and fast take away chain speeds. Additionally, the present invention allows banking in the transfer zone and minimizes the occurrences and effects of drive torque outs, lost production time, and potential component damage resulting from trolleys jamming into one another or into chain pusher dogs within the transfer area.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A power and free conveyor comprising:

a trolley disposed within a free track for movement in a driven direction, said trolley having a retractable dog with a riding surface, said retractable dog being movable between an engaging position and a retracted position;

a first drive chain;

a second drive chain;

a transfer zone having an entrance and an exit, said first drive chain positioned to drivably engage said trolley at said entrance, said second drive chain positioned to drivably engage said trolley at said exit;

a cam bar assembly positioned in said transfer zone to engage said trolley and move said retractable dog from said engaging position to said retracted position, said cam bar assembly including a first cam bar having a first longitudinal axis and a second cam bar having a second longitudinal axis, said second longitudinal axis being offset from said first longitudinal axis; and wherein said first cam bar is positioned for engagement with said riding surface to move said retractable dog from said engaging position to said retracted position and said second cam bar is positioned to follow said first cam bar in said driven direction and to maintain said retractable dog in said retracted position until said riding surface passes said second cam bar.

2. The power and free conveyor of claim 1 wherein said first cam bar has a front end, a rear end, and a cam surface extending between said front end and said rear end to define a surface length therebetween, wherein said second cam bar has a forward end, a rearward end, and a cam face extending between said forward end and said rearward end to define a face length therebetween, wherein said cam surface and cam face each include inner sides, and wherein said offset defines a space between said inner sides.

3. The power and free conveyor of claim 1 wherein said first drive chain drivably engages said trolley while said first cam bar maintains said retractable dog in its retracted position.

4. The power and free conveyor of claim 1 wherein said first drive chain drivably engages said trolley until the riding surface is forward of the second cam bar.

5. The power and free conveyor of claim 1 wherein said trolley includes a tail spaced rearward of said retractable surface and wherein said first drive chain drivably engages said trolley until said tail is forward of the first cam bar.

6. The power and free conveyor of claim 1 wherein the first drive chain drivably engages said trolley when the retractable surface engages the second cam bar.

7. The power and free conveyor of claim 1 wherein said trolley includes a trolley axis and a tail following said riding surface, wherein said riding surface and said tail are centered along said trolley axis, and wherein said first longitudinal axis is coaxial with said trolley axis when said riding surface engages said first cam bar.

8. The power and free conveyor of claim 2 wherein said riding surface has a width and said offset is less than one-half said width.

9. The power and free conveyor of claim 1 wherein said first cam bar has a front end, a rear end, and a cam surface extending between said front end and said rear end to define a surface length therebetween, wherein said second cam bar has a forward end, a rearward end, and a cam face extending between said forward end and said rearward end to define a face length therebetween, and wherein said forward end is spaced forward of said front end in said driven direction.

10. The power and free conveyor of claim 9 wherein said riding surface has a lead end and a trailing end, wherein said trolley includes a tail having a rear tip separated from said trailing surface said forward end being spaced forward of said front end so that said tail is past said forward end when said trailing end passes said front end as said trolley moves in said driven direction.

11. The power and free conveyor of claim 1 wherein said retractable dog has a lateral width and wherein said first and second drive chains each include pushers aligned within the lateral width of the riding surface in the transfer zone.

12. The power and free conveyor of claim 1 wherein said second longitudinal axis is approximately parallel to said first longitudinal axis.

13. The power and free conveyor of claim 2 wherein said trolley includes a tail spaced rearward of said retractable surface and wherein the offset is sized to permit the tail to pass alongside the second cam bar when the retractable dog is in its engaging position.

* * * * *